US008835812B2

(12) United States Patent
Braden et al.

(10) Patent No.: US 8,835,812 B2
(45) Date of Patent: Sep. 16, 2014

(54) HOME APPLIANCE WITH UNITARY BROIL ELEMENT MOUNT AND REFLECTOR

(75) Inventors: Ben Braden, Lafollette, TN (US); Charlie Hanna, Knoxville, TN (US); Timothy Russell, Jacksboro, TN (US)

(73) Assignee: BSH Home Appliances Corporation, Irvine, CA (US)

( * ) Notice: Subject to any disclaimer, the term of this patent is extended or adjusted under 35 U.S.C. 154(b) by 164 days.

(21) Appl. No.: 13/463,076

(22) Filed: May 3, 2012

(65) Prior Publication Data

US 2013/0292369 A1 Nov. 7, 2013

(51) Int. Cl.
*A21B 1/00* (2006.01)
*F27D 11/00* (2006.01)

(52) U.S. Cl.
USPC ..... 219/406; 219/411; 219/412

(58) Field of Classification Search
USPC ..... 219/405, 391–393, 411–412, 385–386, 219/413, 395–399
See application file for complete search history.

(56) References Cited

U.S. PATENT DOCUMENTS 4,629,865 A * 12/1986 Freedman et al. ..... 219/405

* cited by examiner

*Primary Examiner* — Shawntina Fuqua
(74) *Attorney, Agent, or Firm* — James E. Howard; Andre Pallapies

(57) ABSTRACT

A home appliance having an oven with a broil element, the home appliance including an appliance body; an oven cavity defined within the appliance body; a broil element mounted within the oven cavity; a broil element reflector mounted to a wall of the oven cavity; and a mounting arrangement formed integrally with the broil element reflector for mounting the broil element within the oven cavity.

24 Claims, 5 Drawing Sheets

HOME APPLIANCE WITH UNITARY BROIL ELEMENT MOUNT AND REFLECTOR

BACKGROUND OF THE INVENTION

The present invention relates broadly to home appliances having ovens with electric resistive broil elements and, more particularly, to a home appliance, particularly a range, having an improved mounting arrangement for a broil element.

Most every electric range that includes an oven has internal resistive bake and broil elements which are generally curved tubular members that produce heat upon electrical activation. The bake elements are mounted to the floor of the oven cavity while the broil elements are mounted to the roof or top wall of the oven cavity. Typically, a reflector element will be between the broil element and the top wall of the oven for enhanced heating and for mounting the broil element to the oven cavity.

In the past, such broil elements have been difficult to install which also means that they are difficult to remove and replace during repair. As explained more fully below, the old method used two separate brackets that were attached to the reflector with screws that pass into the top wall of the cavity that make installation difficult. Further, such mounting brackets could allow warping or deflection of the broil element during heating.

Currently, there is a need for an improved and more secure arrangement to mount the broil element to the top wall of the cavity.

SUMMARY OF THE INVENTION

The present invention is intended to provide an improved arrangement for mounting a broil element to a broil reflector and in turn to the top wall of the oven cavity that will make installation and removal a more straightforward operation.

The present invention is also intended to provide such a mounting arrangement that will retain the element at specific locations to prevent warping or deflection of the broil element during heating.

The present invention is also intended to provide cost savings by removing the need for separate brackets and wireforms for mounting the broil element to the top wall of the oven cavity.

To those ends, the present invention is directed to a home appliance having an oven with a broil element. The home appliance includes an appliance body and an oven cavity defined within the appliance body. A broil element is mounted within the oven cavity and a broil element reflector mounted to a wall of the oven cavity. A mounting arrangement is formed integrally with the broil element reflector for mounting the broil element within the oven cavity.

Preferably, the broil element is a serpentine electrical resistance element, the reflector is a planar sheet and the mounting arrangement includes a plurality of tabs projecting outwardly from the planar sheet engaged with predetermined portions of the broil element.

It is preferred that the broil element is a tubular member and the plurality of tabs include a cutout for receiving a tubular portion of the broil element. Further, the cutouts may include an entry opening and a support surface, wherein the entry opening is vertically above the support surface.

It is further preferred that the oven cavity defines a centerline wherein a predetermined number of tabs include cutouts open toward the oven centerline and a predetermined number of tabs include cutouts open away from the oven centerline.

Preferably, the reflector is a planar metal sheet and the mounting arrangement includes a plurality of tabs cut in the planar metal sheet, the tabs being bent into a generally perpendicular relationship with the planar sheet, with the tabs projecting outwardly from the planar sheet and engaged with predetermined portions of the broil element.

Preferably, the oven cavity is defined by a plurality of interconnecting walls, including generally vertical side walls and a generally horizontal top wall, with the broil element reflector being mounted to the top wall, and wherein the mounting arrangement includes a plurality of tabs cut in the planar metal sheet and bent into a generally perpendicular relationship with the planar sheet, with the tabs projecting generally vertically downwardly from the planar sheet and engaged with predetermined portions of the broil element.

The serpentine broil element may include a plurality of runs joined by a plurality of loops at a plurality of corners and each of the tabs are adjacent predetermined corners of the broil element. Further, it is preferred that the serpentine broil element includes a plurality of runs joined by a plurality of loops at a plurality of corners and each of the tabs are adjacent each of the loops.

Preferably, the broil element includes eight runs joined by seven loops defining fourteen corners, and the plurality of tabs includes seven tabs adjacent predetermined corners of the broil element, wherein a respective tab is at a respective corner adjacent each of the respective loops.

It is preferred that the serpentine broil element includes a plurality of runs joined by a plurality of loops at a plurality of corners and the plurality of tabs adjacent predetermined corners of the broil element. Preferably, the broil element includes eight runs joined by seven loops defining fourteen corners, and the plurality of tabs includes seven tabs adjacent predetermined corners of the broil element, wherein a tab is at a corner adjacent each of the respective loops.

The present invention is also directed to a range for cooking, the range having an oven with a broil element. The present range includes a range body and an oven cavity defined within the range body. A broil element is mounted within the oven cavity and a broil element reflector mounted to a wall of the oven cavity. A mounting arrangement is formed integrally with the broil element reflector for mounting the broil element within the oven cavity.

Preferably, the broil element is a serpentine electrical resistance element, the reflector is a planar sheet and the mounting arrangement includes a plurality of tabs projecting outwardly from the planar sheet and engaged with predetermined portions of the broil element.

It is preferred that the broil element is a tubular member and each of the tabs includes a cutout for receiving a tubular portion of the broil element. The cutouts may include an entry opening and a support surface, wherein the entry opening is vertically above the support surface.

Preferably, the oven cavity defines a centerline and a predetermined number of tabs include cutouts open toward the oven centerline and a predetermined number of tabs include cutouts open away from the oven centerline.

It is preferred that the reflector is a planar metal sheet and the mounting arrangement includes a plurality of tabs cut in the planar metal sheet with the tabs being bent into a generally perpendicular relationship with the planar sheet, with the tabs projecting outwardly from the planar sheet and engaged with predetermined portions of the broil element.

Preferably, the oven cavity is defined by a plurality of interconnecting walls, including generally vertical side walls and a generally horizontal top wall, with the broil element reflector being mounted to the top wall, and wherein the mounting arrangement includes a plurality of tabs cut in the planar metal sheet and bent into a generally perpendicular relationship with the planar sheet, with the tabs projecting generally vertically downwardly from the planar sheet and engaged with predetermined portions of the broil element.

It is preferred that the serpentine broil element includes a plurality of runs joined by a plurality of loops at a plurality of corners and the plurality of tabs are adjacent predetermined corners of the broil element. It is further preferred that the serpentine broil element includes a plurality of runs joined by a plurality of loops at a plurality of corners and the each of the plurality of tabs are adjacent each of the loops.

Preferably, the broil element includes eight runs joined by seven loops defining fourteen corners, wherein the plurality of tabs includes seven tabs adjacent predetermined corners of the broil element, with a tab at a corner adjacent each of the respective loops. It is further preferred that the serpentine broil element includes a plurality of runs joined by a plurality of loops at a plurality of corners and the plurality of tabs are adjacent predetermined corners of the broil element. Finally, the broil element may include eight runs joined by seven loops defining fourteen corners, and wherein the plurality of tabs includes seven tabs adjacent predetermined corners of the broil element, wherein a tab is at a corner adjacent each of the respective loops.

DESCRIPTION OF THE PREFERRED EMBODIMENT

Figure 1:
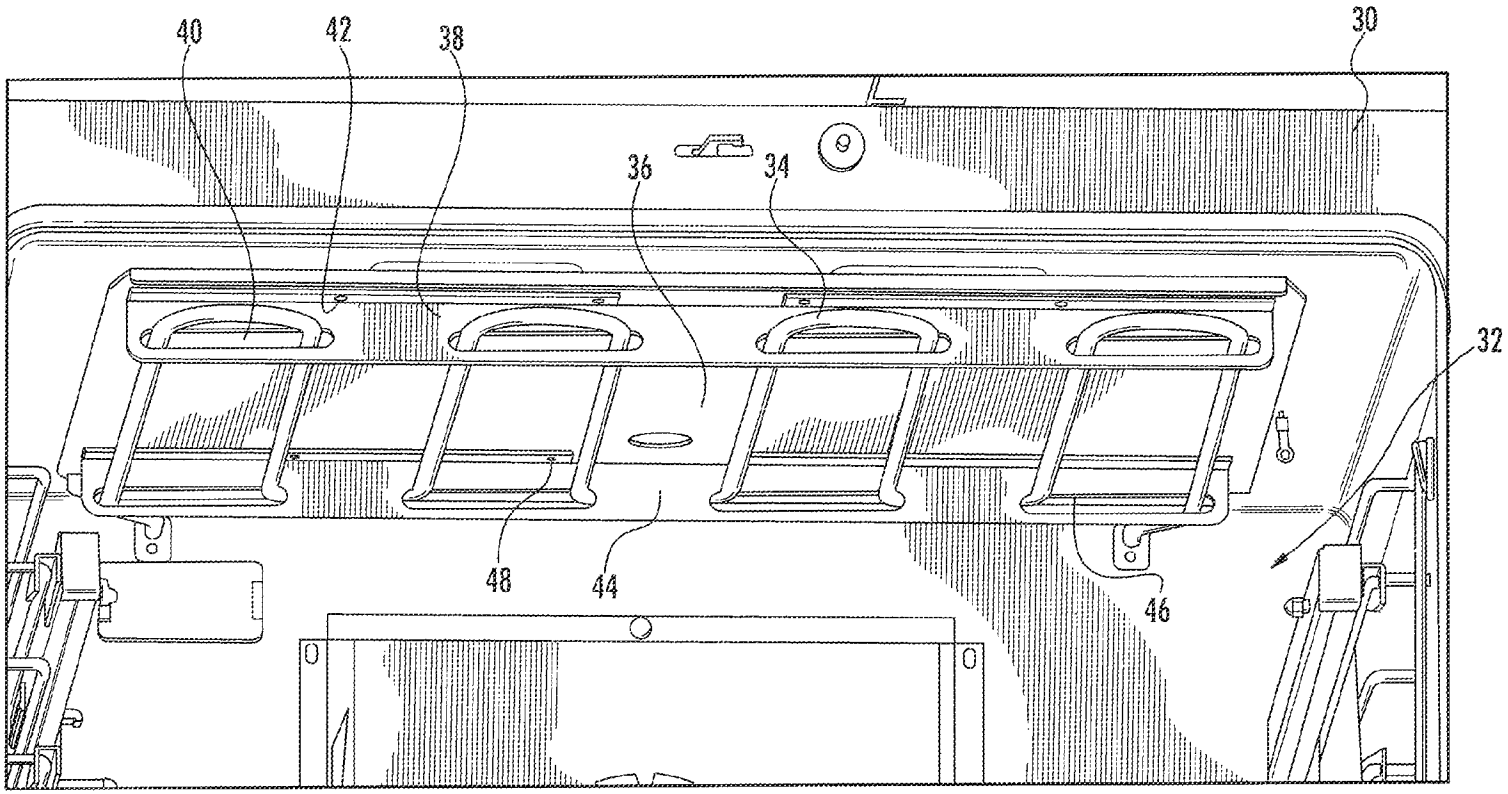
FIG. 1 (PRIOR ART)
FIG. 1 is a front perspective view of a prior oven illustrating the prior broil element mounting structure.

Turning now to the drawings and, more particularly to FIG. 1, a prior art range is illustrated at 30 and defines an oven cavity. A resistive broil element 34 is mounted to a top wall of the oven cavity 32 for heating and cooking food on a rack (not shown) below the broil element 34. The broil element 34 is plugged into electrical connections at the rear of the oven 32. As is known with resistive cooking elements, the broil element is serpentine in shape and, due to the mounting structure, appears in FIG. 1 as a series of four U-shaped members. Nevertheless, it will be understood by those skilled in the art that connecting portions of the broil element 34 are hidden due to the bracket structure and a single, tubular rod forms the serpentine broil element.

The broil element 34 is mounted to a reflector 36 that is in turn mounted to the top wall of the oven 32 using two brackets 38, 44. A front bracket 38 is a generally elongate planar member that extends traversely across the top wall of the oven 32 from one lateral extent of the broil element 34 to the other. The bracket 38 is attached to the reflector 36 using screws 42. A linear array of oval openings 40 are defined in the bracket 44 in order to accommodate the entire U-shaped structure of the broil element 34.

A similar rear bracket 44 is mounted to the reflector 36 using screws 48. The rear bracket 44 is configured like the front bracket 38 as a generally elongate, planar member having a series of oval openings 46 through which a portion of the broil element 34 can pass.

As can be seen from the above, the brackets 38, 44 are screwed to the reflector 36 and ultimately the top wall of the oven 32. The brackets 38, 44 support the U-shaped portions of the broil element 34 in a loose manner and such support is improved upon by the present invention.

Figure 2:
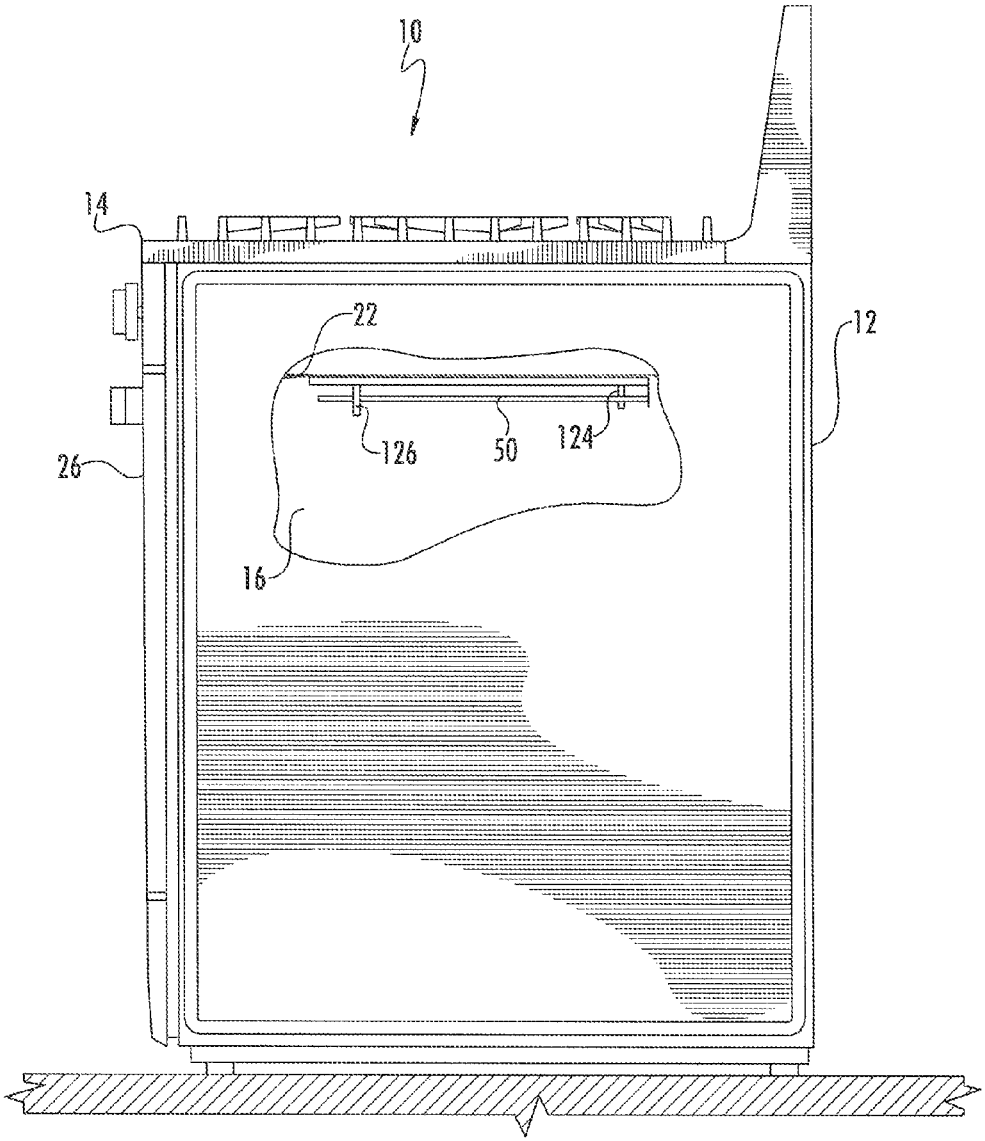
FIG. 2 is a side view of a range broken open to illustrate a broil element according to one preferred embodiment of the present invention.

Turning now to FIG. 2, a range is illustrated generally at 10 and includes a floorstanding, boxlike range body 12 defining an oven 16. The oven 16 is covered by a door 26. A range top 14 or cooktop is on top of the range body 12 above the oven 16. As seen in the open portion of the range 10, a broil element 50 extends across a top wall 22 of the oven 16. Tabs 126, 124 at the front and rear of the broil element 50 support the broil element 50.

Figure 3:
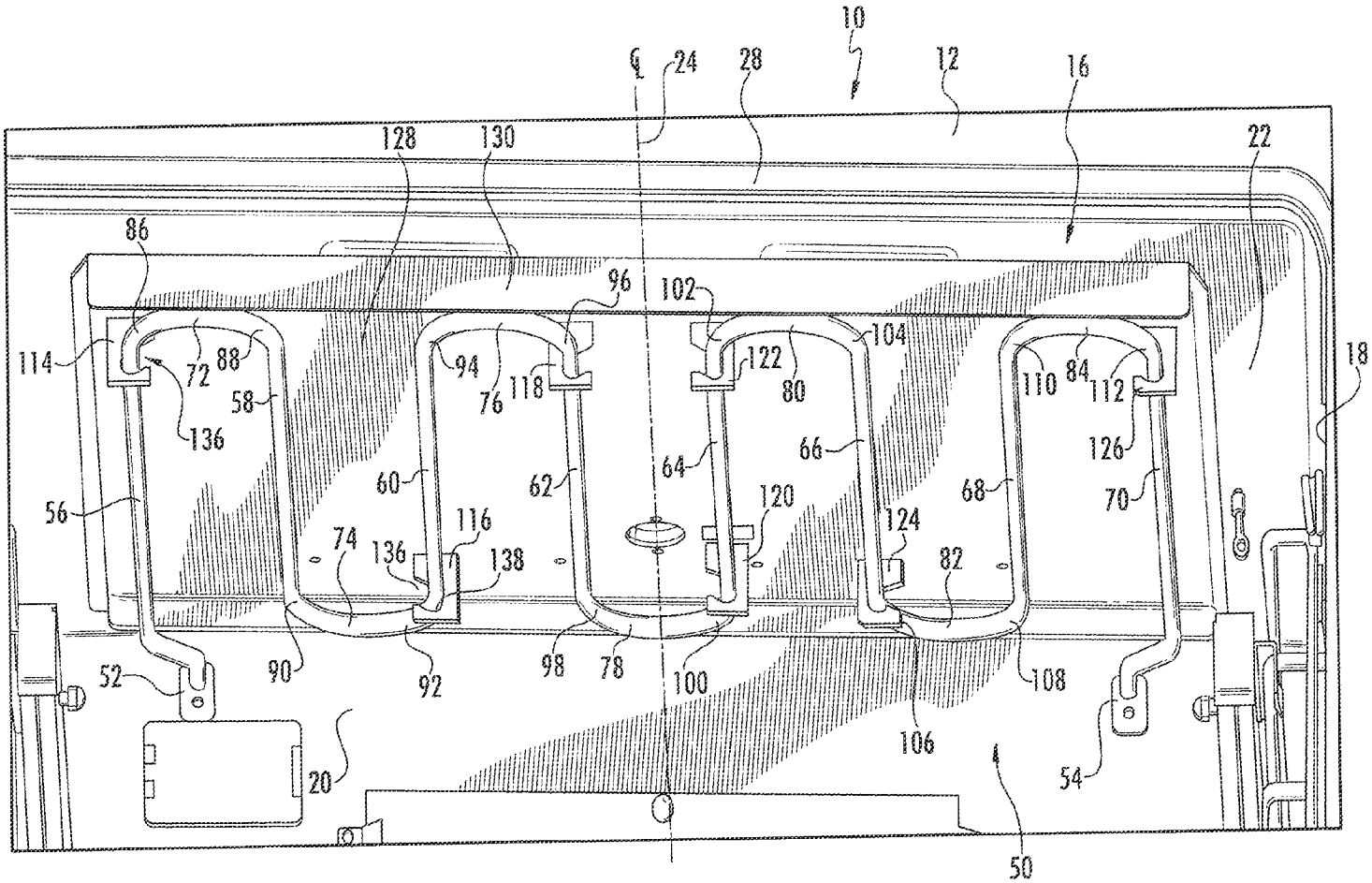
FIG. 3 is a front perspective view of a broil element and associated mounting structure illustrated in FIG. 1.

Turning now to FIG. 3, an interior of the oven 16 is illustrated from the vantage point of an open door. The oven 16 includes sidewalls 18, a rear wall 20, a top wall 22 and a bottom wall (not shown). The opening to the oven 16 is surrounded by a gasket 28. An imaginary, horizontally extending centerline 24 divides the oven into left and right portions for the purposes of the present discussion. In that regard, when the present discussion refers to a left-to-right progression, the perspective is from the viewer's left to the viewer's right.

With continued reference to FIG. 3, the broil element 50 is plugged into the rear wall 20 of the oven 16 at a first electrical connector 52 on one end and a second electrical connector 54 on the other. The broil element 50 is a tubular member formed into a series of runs and loops joined by corner portions or, for brevity, corners. There are eight linear runs, and seven loops defining a serpentine structure. As will be seen, tabs are provided at specific, predetermined locations to support the broil element 50 in a manner that will resist twisting and warping when the resistive broil element 50 is heated to operational temperature.

Proceeding from left to right in FIG. 3, a first linear run 56 extends from the left electrical connector 52 from back to front and is joined to a first loop 72 at a first corner 86. The first loop 72 curves the broil element 50 back into a second run 58 that extends from a second corner 88, front to back, to a third corner 90 adjacent the rear wall 20 of the oven 16. A second loop 74 extends from the third corner 90 at the second run 58 to a fourth corner 92 wherein the broil element 50 is turned to extend from back to front through the third run 60. The third loop 76 joins the third run 60 at a fifth corner 94 and bends the broil element 50 to a sixth corner 96 where it is reversed and attaches to the fourth run 62 to extend from front to back. The fourth run 62 ends at a seventh corner 98 and bends into the fourth loop 78 that goes through the centerline 24 of the oven. As will be seen, the remaining portion of broil element 50 is a mirror image of the first portion.

From the centerline 24, the fourth loop 78 extends to the eighth corner 100 where it once again turns to extend from back to front through the fifth run 64. The fifth run 64 ends at the ninth corner 102 and the broil element 50 extends through the fifth loop 80 to the tenth corner 104. From there, the broil element 50 extends from front to back through the sixth run 66 ending at the eleventh corner 106 where the sixth loop 82 extends to the twelfth corner 108. From the twelfth corner 108, the seventh run 68 extends from back to front ending at the thirteenth corner 110. The seventh and final loop 84 extends from the thirteenth corner 110 to the fourteenth corner 112 to reverse direction of the broil element 50 to again extend from front to back along the eighth run 70 to the second electrical connector 54.

Figure 4:
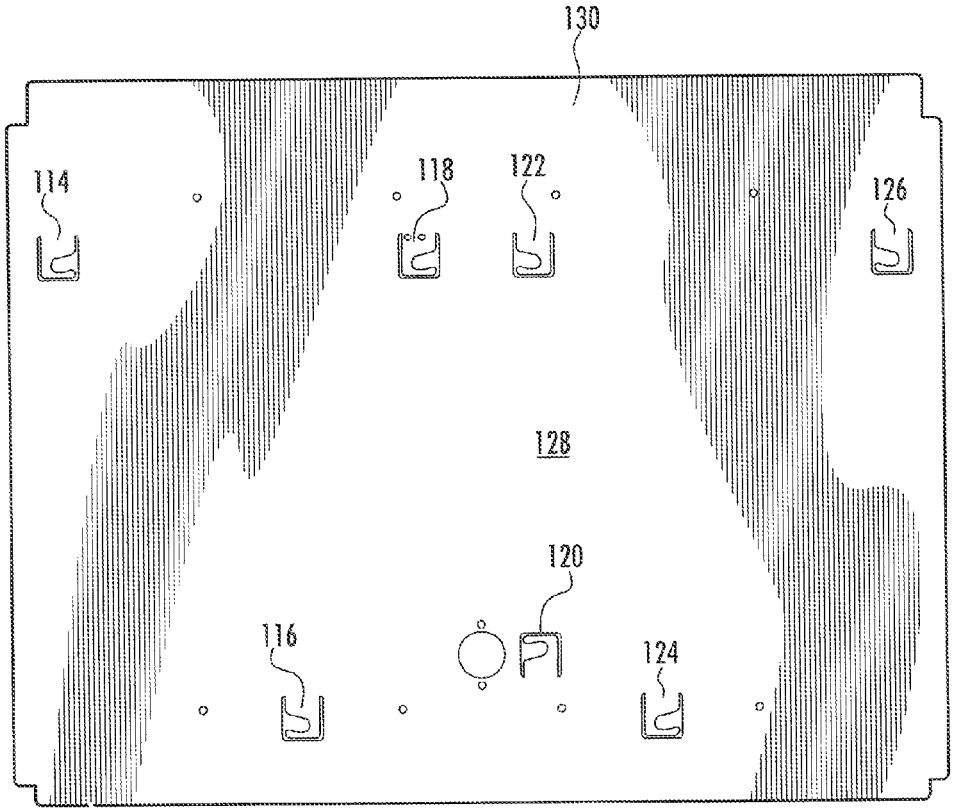
FIG. 4 is top-plan view of a reflector having broil element mounting tabs cut therein.
Figure 5:
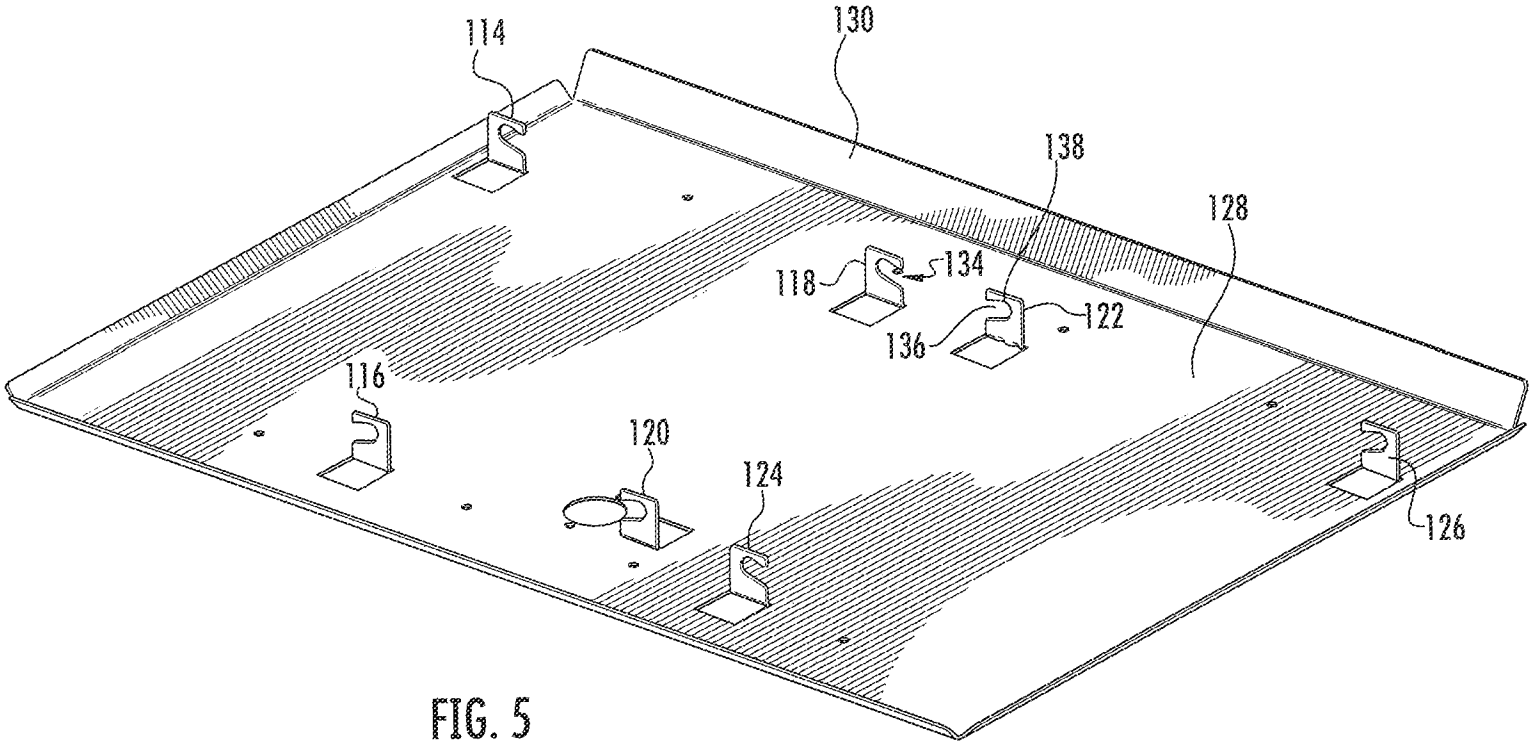
FIG. 5 is a perspective view of the broil element reflector illustrated in FIG. 4 showing the tabs bent to an operational position.

A plurality of tabs project outwardly from the reflector 128 to support the tubular broil element 50. As seen in FIGS. 3, 4 and 5, each tab 114, 116, 118, 120, 122, 124, 126 is a generally rectangular member having a cutout to receive a portion of the tubular broil element 50. As seen in FIG. 4, the tabs are cut from a sheet of metal which becomes the reflector 128. Each tab has the same structure, so explanation of one tab will suffice to explain the entire set of seven tabs. For example, and with reference to FIG. 5, each tab is a generally rectangular member having a cutout 134 defining a cutout opening 136 leading to a support surface 138. When in use, the opening 136 to the cutout is vertically above the support surface 138 such that the broil element 50 can slide in the cutout 134 and move generally downwardly to rest on the support surface 138. The broil element tube portion must be lifted or raised in order to exit the respective tab. As seen in FIG. 4, each of the tabs is cut into the sheet metal and, as seen in FIG. 5, bent upwardly to define the respective tab. A shield 130 extends along one edge of the reflector 128 and is folded in the direction of the tab folds, to extend downwardly from the top wall 22 of the oven 16.

Returning to FIG. 3, and extending from left to right, a first tab 114 is at the first corner 86 with the opening 134 facing the centerline 24 of the oven 16. A second tab 116 is at the fourth corner 92 with the cutout facing away from the centerline 24 of the oven 16. A third tab 118 is at the sixth corner 96 with the tab cutout 136 facing the centerline 24 of the oven 16. While the tabs are discussed as being at the corners, the tabs are adjacent the corners and support a portion of a run rather than a corner of the tubular broil element 50.

A fourth tab 120 is at the eighth corner 100 with a cutout 136 facing the centerline 24 of the oven 16. A fifth tab 122 is adjacent the ninth corner 102 with the cutout 136 facing the centerline 24 of the oven 16. A sixth tab 124 is at the eleventh corner 106 with the cutout 136 facing away from the centerline 24 of the oven 16. A seventh and final tab 126 is adjacent the fourteenth corner 112 with the cutout opening 136 facing the centerline 24 of the oven 16.

Based on the foregoing, it can be seen that the broil element 50 is supported at seven different places with tabs that, for the most part, reverse direction of the cutout as proceeding from left to right across FIG. 3. The exception is the fifth tab 122 and sixth tab 124 which are at the eighth corner 100 and the ninth corner 102, respectively. Further, despite the presence of the fourth tab 120, the other tabs are place symmetrically on either side of the centerline 24. Since there are seven loops and seven tabs, no loop is left unsupported and, as such, the present mounting arrangement provides stability to the broil element 50. Accordingly, the broil element 50 will resist warping or deflection during heating because the present tabs allow for more free expansion of the broil element 50 than did the prior mounting structure illustrated in FIG. 1.

By the above, the present invention provides an improved and simplified mounting arrangement for a broil element in an oven that is more cost-effective to produce and enhances the structural strength and rigidity of a broil element.

It will therefore be readily understood by those persons skilled in the art that the present invention is susceptible of a broad utility and application. While the present invention is described in all currently foreseeable embodiments, there may be other, unforeseeable embodiments and adaptations of the present invention, as well as variations, modifications and equivalent arrangements, that do not depart from the substance or scope of the present invention. The foregoing disclosure is not intended or to be construed to limit the present invention or otherwise to exclude such other embodiments, adaptations, variations, modifications and equivalent arrangements, the present invention being limited only by the claims appended hereto and the equivalents thereof.

What is claimed is:

1. A home appliance having an oven with a broil element, the home appliance comprising:

an appliance body;

an oven cavity defined within the appliance body;

a broil element mounted within the oven cavity;

a broil element reflector mounted to a wall of the oven cavity; and a mounting arrangement formed from portions of the broil element reflector for mounting the broil element within the oven cavity.

2. The home appliance of claim 1 wherein the broil element is a serpentine electrical resistance element, the reflector is a planar sheet and the mounting arrangement includes a plurality of tabs formed from cut out portions of the planar sheet, projecting outwardly from the planar sheet and engaged with predetermined portions of the broil element.

3. The home appliance of claim 2 wherein broil element is a tubular member and each of the tabs include a cutout for receiving a tubular portion of the broil element.

4. The home appliance of claim 3 wherein the cutouts each include an entry opening in a side of each tab and a support surface, wherein the entry opening is vertically above the support surface, and wherein the cutout is configured to receive the tubular portion of the broil element and direct the tubular portion of the broil element downwardly away from the entry opening.

5. The home appliance of claim 4 wherein the oven cavity defines a centerline wherein a predetermined number of first tabs have a first configuration defining cutouts open toward the oven centerline and a predetermined number of second tabs have a second configuration different from the first configuration defining cutouts open away from the oven centerline.

6. The home appliance of claim 1 wherein the reflector is a planar metal sheet and the mounting arrangement includes a plurality of tabs cut in the planar metal sheet and bent into a generally perpendicular relationship with the planar sheet, with the tabs projecting outwardly from the planar sheet and engaged with predetermined portions of the broil element.

7. The home appliance of claim 1 wherein the oven cavity is defined by a plurality of interconnecting walls, including generally vertical side walls and a generally horizontal top wall, with the broil element reflector being mounted to the top wall, wherein the mounting arrangement includes a plurality of tabs cut in the planar metal sheet and bent into a generally perpendicular relationship with the planar sheet, with the tabs projecting generally vertically downwardly from the planar sheet and engaged with predetermined portions of the broil element.

8. The home appliance of claim 7 wherein the serpentine broil element includes a plurality of runs joined by a plurality of loops at a plurality of corners and each of the tabs are adjacent predetermined corners of the broil element.

9. The home appliance of claim 7 wherein the serpentine broil element includes a plurality of runs joined by a plurality of loops at a plurality of corners and each of the tabs are adjacent each of the loops.

10. The home appliance of claim 9 wherein the broil element includes eight runs joined by seven loops defining fourteen corners, and wherein the plurality of tabs includes seven tabs adjacent predetermined corners of the broil element, wherein a tab is at a corner adjacent each of the respective loops.

11. The home appliance of claim 2 wherein the serpentine broil element includes a plurality of runs joined by a plurality of loops at a plurality of corners and the plurality of tabs are adjacent predetermined corners of the broil element.

12. The home appliance of claim 11 wherein the broil element includes eight runs joined by seven loops defining fourteen corners, and wherein the plurality of tabs includes seven tabs adjacent predetermined corners of the broil element, wherein a tab is at a corner adjacent each of the respective loops.

13. A range having an oven with a broil element, the range comprising:

a range body;

an oven cavity defined within the appliance body;

a broil element mounted within the oven cavity;

a broil element reflector mounted to a wall of the oven cavity; and a mounting arrangement formed from portions of the broil element reflector for mounting the broil element within the oven cavity.

14. The range of claim 13 wherein the broil element is a serpentine electrical resistance element, the reflector is a planar sheet and the mounting arrangement includes a plurality of tabs formed from portions of the planar sheet, projecting outwardly from the planar sheet and engaged with predetermined portions of the broil element.

15. The range of claim 14 wherein broil element is a tubular member and each of the tabs includes a cutout for receiving a tubular portion of the broil element.

16. The range of claim 15 wherein the cutouts each include an entry opening in a side of each tab and a support surface, wherein the entry opening is vertically above the support surface, and wherein the cutout is configured to receive the tubular portion of the broil element and direct the tubular portion of the broil element downwardly away from the entry opening.

17. The range of claim 16 wherein the oven cavity defines a centerline wherein a predetermined number of first tabs have a first configuration defining cutouts open toward the oven centerline and a predetermined number of second tabs have a second configuration different from the first configuration defining cutouts open away from the oven centerline.

18. The range of claim 13 wherein the reflector is a planar metal sheet and the mounting arrangement includes a plurality of tabs cut in the planar metal sheet and bent into a generally perpendicular relationship with the planar sheet, with the tabs projecting outwardly from the planar sheet and engaged with predetermined portions of the broil element.

19. The range of claim 13 wherein the oven cavity is defined by a plurality of interconnecting walls, including generally vertical side walls and a generally horizontal top wall, the broil element reflector being mounted to the top wall, wherein the mounting arrangement includes a plurality of tabs cut in the planar metal sheet and bent into a generally perpendicular relationship with the planar sheet, with the tabs projecting generally vertically downwardly from the planar sheet and engaged with predetermined portions of the broil element.

20. The range of claim 19 wherein the serpentine broil element includes a plurality of runs joined by a plurality of loops at a plurality of corners and the tabs are adjacent predetermined corners of the broil element.

21. The range of claim 19 wherein the serpentine broil element includes a plurality of runs joined by a plurality of loops at a plurality of corners and each of the tabs are adjacent each of the loops.

22. The range of claim 21 wherein the broil element includes eight runs joined by seven loops defining fourteen corners, and wherein the plurality of tabs includes seven tabs adjacent predetermined corners of the broil element, wherein a tab is at a corner adjacent each of the respective loops.

23. The range of claim 14 wherein the serpentine broil element includes a plurality of runs joined by a plurality of loops at a plurality of corners and the tabs are adjacent predetermined corners of the broil element.

24. The range of claim 23 wherein the broil element includes eight runs joined by seven loops defining fourteen corners, and wherein the plurality of tabs includes seven tabs adjacent predetermined corners of the broil element, wherein a tab is at a corner adjacent each of the respective loops.

* * * * *